United States Patent [19]

Bonner et al.

[11] 4,223,295

[45] Sep. 16, 1980

[54] EMERGENCY CONTROL SYSTEM FOR TRAFFIC SIGNALS

[75] Inventors: Edgar L. Bonner, Taylorsville, N.C.; Nelson A. Faerber, 900 Sixth Ave. South, Naples on the Gulf, Fla. 33940

[73] Assignee: Nelson A. Faerber, Naples, Fla.

[21] Appl. No.: 952,554

[22] Filed: Oct. 18, 1978

[51] Int. Cl.[2] ..... G08G 1/07

[52] U.S. Cl. ..... 340/32; 340/147 LP; 455/99; 340/694

[58] Field of Search ..... 340/32, 33, 34, 37, 340/41 R, 147 LP; 325/111, 117, 392, 310, 304; 343/225, 228

[56] References Cited

U.S. PATENT DOCUMENTS

| | | | |
|---|---|---|---|
| 2,881,409 | 4/1959 | Cook et al. | 340/32 |
| 3,257,641 | 6/1966 | Campana et al. | 340/33 |
| 3,550,078 | 12/1970 | Long | 340/32 |
| 3,631,387 | 12/1971 | Hill et al. | 340/37 |
| 3,638,179 | 1/1972 | Coll et al. | 340/32 |
| 3,881,169 | 4/1975 | Malach | 340/32 |
| 4,017,825 | 4/1977 | Pichey | 340/32 |
| 4,162,477 | 7/1977 | Munkberg | 340/32 |

FOREIGN PATENT DOCUMENTS

| | | | |
|---|---|---|---|
| 2610443 | 9/1977 | Fed. Rep. of Germany | 340/33 |

*Primary Examiner*—John W. Caldwell, Sr.
*Assistant Examiner*—James J. Groody
*Attorney, Agent, or Firm*—Blair, Brown & Kreten

[57] ABSTRACT

An emergency control system for traffic signals in which a coded emergency signal transmitted from an emergency vehicle is picked up by a directional receiver associated with the traffic signals and a command emergency signal generated which activates a control unit by means of which the existing state of the traffic signals is sampled and the information stored after which the control unit switches control of the traffic signals from the main controller to the control unit which determines from the stored information the existing state of the traffic signals and the information from the receiver as to the direction of approach of the emergency vehicle, the correct sequence for placing the traffic signals in the proper state, the discontinuation of the emergency signal initiating the return of control of the traffic signals to the main controller by the control unit on the first amber light function output from the main controller.

16 Claims, 14 Drawing Figures

FIG. 1
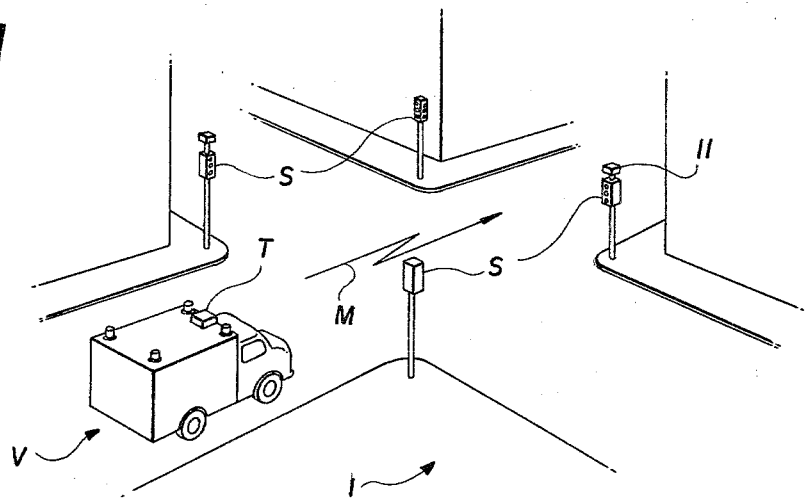
FIG. 2
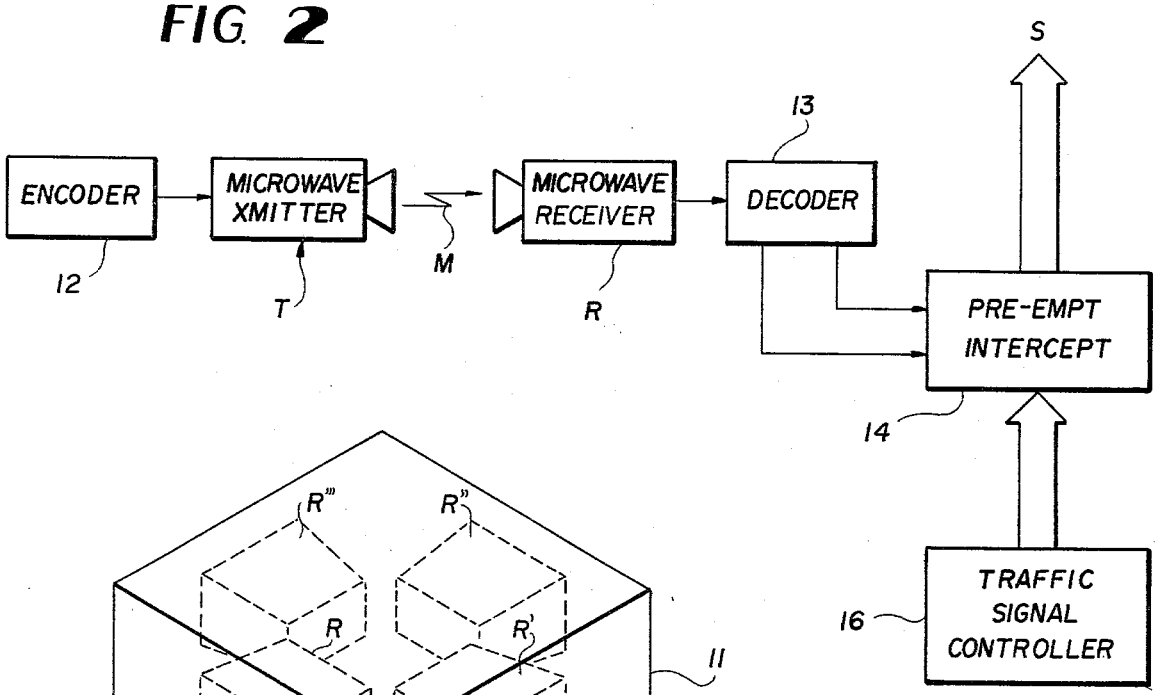
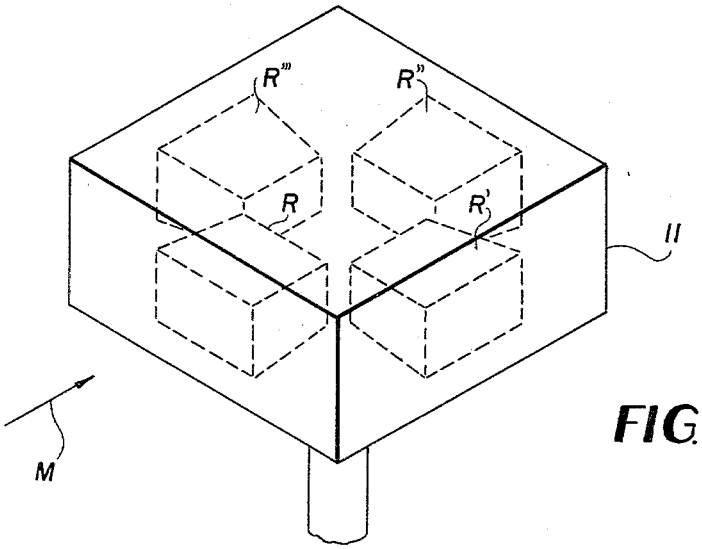
FIG. 3

EMERGENCY CONTROL SYSTEM FOR TRAFFIC SIGNALS

BACKGROUND OF THE INVENTION

This invention relates to control apparatus for traffic signals and more particularly to a system for controlling traffic signals under emergency conditions.

DESCRIPTION OF THE PRIOR ART

Under modern day traffic conditions and particularly in high density traffic areas there is a vital need for the provision of a system of modifying the normal operating sequence of traffic signals at an intersection to permit the unimpeded and safe passage of emergency vehicles such as ambulances, police vehicles and the like through the intersection. Not only must the emergency vehicle be free to move through the intersection in a selected direction of travel but the traffic flow from other directions which could interfere with the movement of the emergency vehicle must be stopped under the appropriate traffic signal indication. A number of present day systems have been utilized to accomplish this purpose all of which have fallen short of the desired result. A common approach has been to provide an apparatus on the emergency vehicle for transmitting an emergency signal to a receiver associated with the traffic signals whereby the main controller for the traffic signals, which has been suitably modified, is actuated to operate the traffic signals in an emergency sequence. Such modification of the traffic signal's controller is not only costly but due to the heavy load requirements and continuous switching activity of such present day controllers, reliability of operation can be achieved only by a intensive preventive maintenance program. Therefore, the high degree of reliability which is mandatory for any emergency traffic control system is difficult to achieve when such a present day controller is relied upon for both routine and emergency operation of traffic signals.

Various systems are utilized in present day systems for transmitting an emergency signal for controlling the traffic signals at an intersection in advance of an emergency vehicle. In one system, the signal from a transmitter in the emergency vehicle is picked up by a receiver installed in the pavement at some distance from the intersection as the emergency vehicle crosses the area of the pavement in which the receiver is installed with the main controller for the traffic signals ahead being conditioned for emergency operation. Such an installation is not only costly from a construction standpoint but presents maintenance problems so as to limit the reliability of such a system. The type of emergency signal transmitted by the emergency vehicle is also subject to variation in present day systems. For instance, one system utilizes a flashing light beam mounted on the vehicle with an optical receiving system located at the intersection by means of which emergency operation of the main controller for the traffic signals is affected. Other systems utilize a low radio frequency signal with the direction information supplied by the vehicle operator or ultrasonic sound with receivers for both of such systems being located remote from the intersection along the avenue of approach. All of these emergency signal transmitting arrangements are adversely affected by weather conditions such as rain, snow, ice, fog and the like. The susceptibility of optical systems to adverse weather conditions is obvious and both low radio frequency and ultrasonic sound systems require special installation or operator attention which is undesirable.

Regardless of the emergency signal transmitting system utilized, the common practice in all of these systems is to modify the main controller for traffic systems on a custom basis to accommodate the controller to the system utilized. Thus, not only is the main controller utilized for emergency operation of the traffic signals but regardless of the effectiveness of the transmission system utilized, it is the modified main controller which is required to function under emergency conditions.

Accordingly, the primary object of this invention is to provide a new and novel system for controlling traffic signals under emergency conditions.

Another object of this invention is to provide a new and novel emergency control system for traffic signals which does not rely on the main controller for the traffic signals for operation of the under-emergency conditions.

Still another object of this invention is provide a new and novel emergency control system for traffic signals which may be used with any type of emergency signal transmission system and which may be easily installed in associated with an existing traffic control system at low cost both from the cost of the system as well as the cost of installation.

A still further object of this invention is to provide a new and novel emergency control system for traffic systems which is totally immune to adverse weather conditions and which not only provides a high degree of reliability of safety but which is virtually maintenance free.

Still another object of this invention is to provide a new and novel emergency control system for traffic signals which is simple and compact in construction, which utilize readily available component parts which may be of modular construction for easy repair and replacement and which may be readily expanded or adapted from the most elementary traffic signal arrangement to the most complex utilizing a building block concept.

SUMMARY OF THE INVENTION

The objects as stated above and other related objects are accomplished by the provision of a plurality of receivers operatively associated with traffic signals at an intersection and oriented to each direction of approach respectively of an emergency vehicle provided with a transmitter for transmitting a coded emergency beam, the receivers being oriented so that only the receiver aligned with the direction of approach is activated. The activated receiver responds only to the coded transmitted signal to generate a command emergency signal for activating a control unit through which the existing state of the traffic signals is sampled and the information stored setting the internal controls of the unit to correspond with the stored information. Switching means are provided which, in one position, connect the main controller for the traffic signals to the traffic lights and which are actuated by the control unit to assume control of the signals during the emergency condition permitting the main controller to continue to function normally, the traffic signals being under control of the unit as long as the emergency condition exists. The control unit utilizes the information on the existing state of the traffic signals and the information from the receiver which indicates the direction of approach of the emergency vehicle and places the traffic signals in the proper state for emergency conditions as long as the emergency signal exists. When the emergency signal is discontinued, the control unit computes the sequence necessary to return the signals to the main controller and the switching means is actuated to return the signals to the main controller on the first amber light function output from the main controller.

The invention will be better understood and the other objects and advantages thereof will become more apparent from the following detailed description of the invention taken in conjunction with the drawings.

BRIEF DESCRIPTION OF THE DRAWINGS

FIG. 1 is a perspective view of a traffic intersection having traffic signals incorporating the emergency control system of the invention and showing the approach of an emergency vehicle;

FIG. 2 is a schematic block diagram of the emergency control system of the invention;

FIG. 3 is a perspective view illustrating the arrangement of the receivers of the invention associated with the traffic signals;

DESCRIPTION OF THE PREFERRED EMBODIMENT

Figure 4:
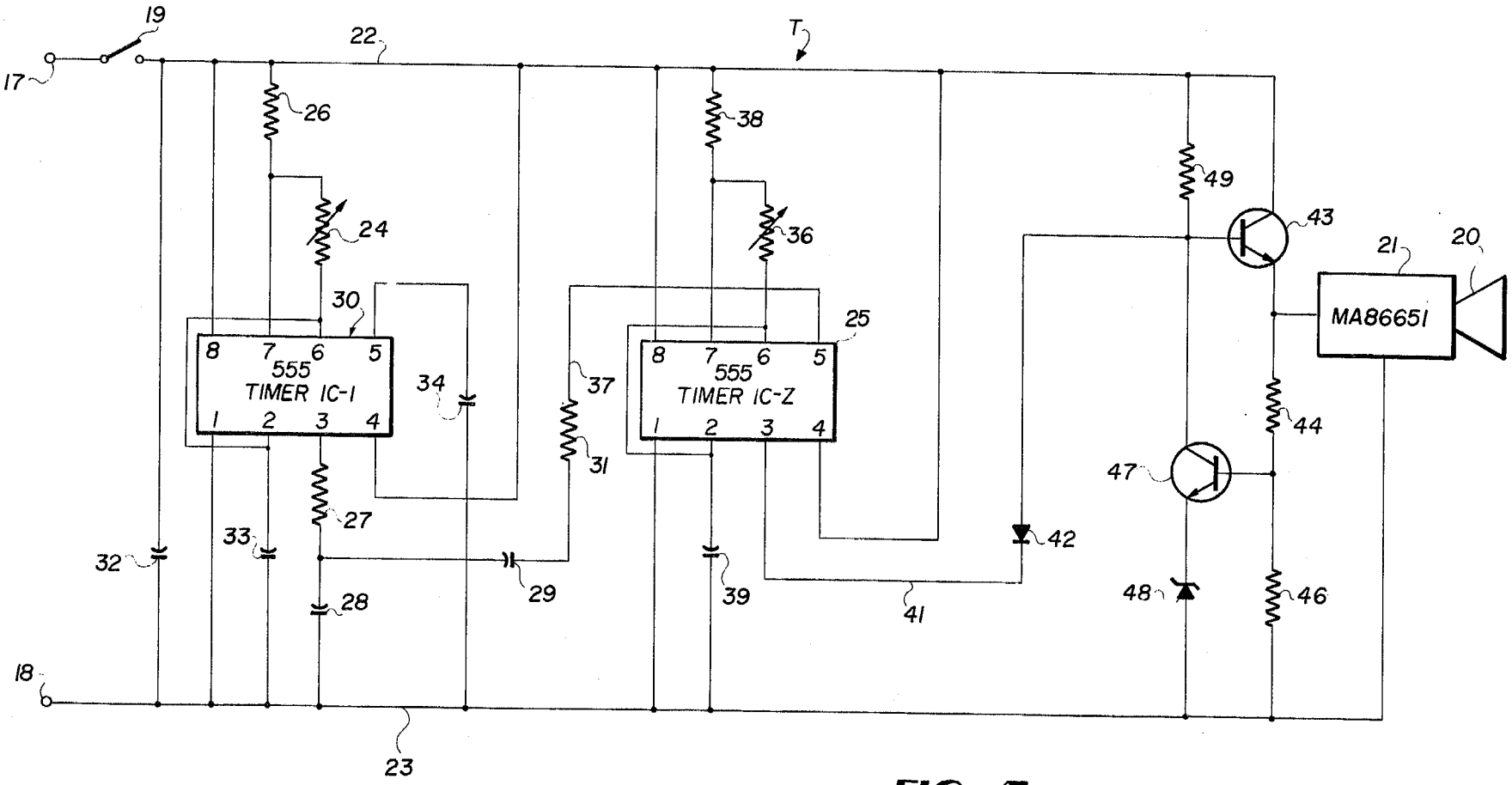
FIG. 4 is a schematic diagram of the transmitter of the invention.

Referring now to FIG. 1 there is shown a typical 4-way traffic intersection I at each corner of which is located conventional traffic signals S having red, amber and green traffic lights. At least one of the traffic signals preferably two as shown in the embodiment of FIG. 1 has associated therewith a receiver housing 11 as shown best in FIG. 3, in the interior of which are disposed a plurality of receivers R, R′, R″, R‴ which include a directional horn antenna and each oriented respectively to one of the four directions of approach of an emergency vehicle V such as an ambulance or the like. As can be understood, the emergency vehicle V is provided with a transmitter T which transmits a directional beam of electromagnetic energy M in the direction of travel so that the directional beam is received by the receiver oriented in the direction of travel.

In the illustrated embodiment, the transmitter T is of the microwave type and includes a code encoder 12 as shown in FIG. 2 which generates a special AM/FM tone code for modulating a microwave oscillator. As shown in FIG. 2, the transmitted microwave M is received by the appropriate microwave receiver R through R‴ and if the specific tone code is present, a tone decoder 13 associated with the receiver decodes the tone code for activating the control unit or preempt intercept unit 14 of the invention. As shown in FIG. 2, the preempt intercept unit 14 is connected between the main traffic signal controller 16 and the signals S so as to assume control of the signals S from and back to the traffic signal controller 16 as will be explained hereinafter.

Referring now to FIG. 4, there is shown schematically the transmitter T if the invention which is suitably mounted on the emergency vehicle V. The transmitter T is arranged to be energized across terminals 17, 18 from a twelve volt power supply through a on/off switch 19 which supplies power to the transmitter for initiating the transmission of the beam of electromagnetic energy M from a horn antenna 20. The transmitter T comprises a microwave oscillator 21 amplitude modulated with a 10 kHz tone which is frequency modulated by a 250 Hz subtone. In the circuit of FIG. 4, IC-1 is a type 555 timer 30 connected as a precision oscillator at 250 Hz and is connected across conductors 22, 23. The frequency of timer 30 is set by adjustment of variable resistor 24 connected at one side to pins 6/2 and at the other side through resistor 26 to conductor 22. The output of timer 30 is filtered by the network consisting of resistor 27 and capacitor 28 and is fed through coupling capacitor 29 and resistor 31 to the input of IC-2 comprising a 555 timer 25. Capacitor 32 is connected between conductors 22, 23 and trigger pin 2 of timer 30 is connected through capacitor 33 to conductor 23. Discharge pin 7 is connected between variable resistor 24 and resistor 26 and the control voltage pin 5 is connected through capacitor 34 to conductor 23.

IC-2 is a 555 timer 25 similar to IC-1 and is connected as a precision oscillator at 10 kHz. The frequency of timer 25 is controlled by variable resistor 36 and when the filtered subtone is applied to pin 5 of timer 25 through conductor 37, the internal reference voltage is modulated and frequency modulates the output of timer 25 on pin 3 by about 10 percent at the 250 Hz subtone rate. The variable resistor 36 is connected at one side to the threshold pins 6/2 and at its other side through resistor 38 to conductor 22. Discharge pin 7 of timer 25 is connected between the variable resistor 26 and resistor 38 and the trigger pin 2 is connected through capacitor 39 to conductor 23.

The output of timer 25 from pin 3 is connected by conductor 41 through diode 42 to the base of transistor 43 forming an output stage to drive the microwave oscillator 21. The collector of transistor 43 is connected to conductor 22 and the emitter through resistors 44, 46 to conductor 23. The emitter of transistor 47 is connected through zener diode 48 to conductor 23 and the collector is connected through resistor 49 to conductor 22 serving to clamp the output voltage to 7.5 volts peak regardless of the dc input supply voltage at terminals 17, 18. The base of transistor 47 is connected between resistors 44, 46.

Figure 5:
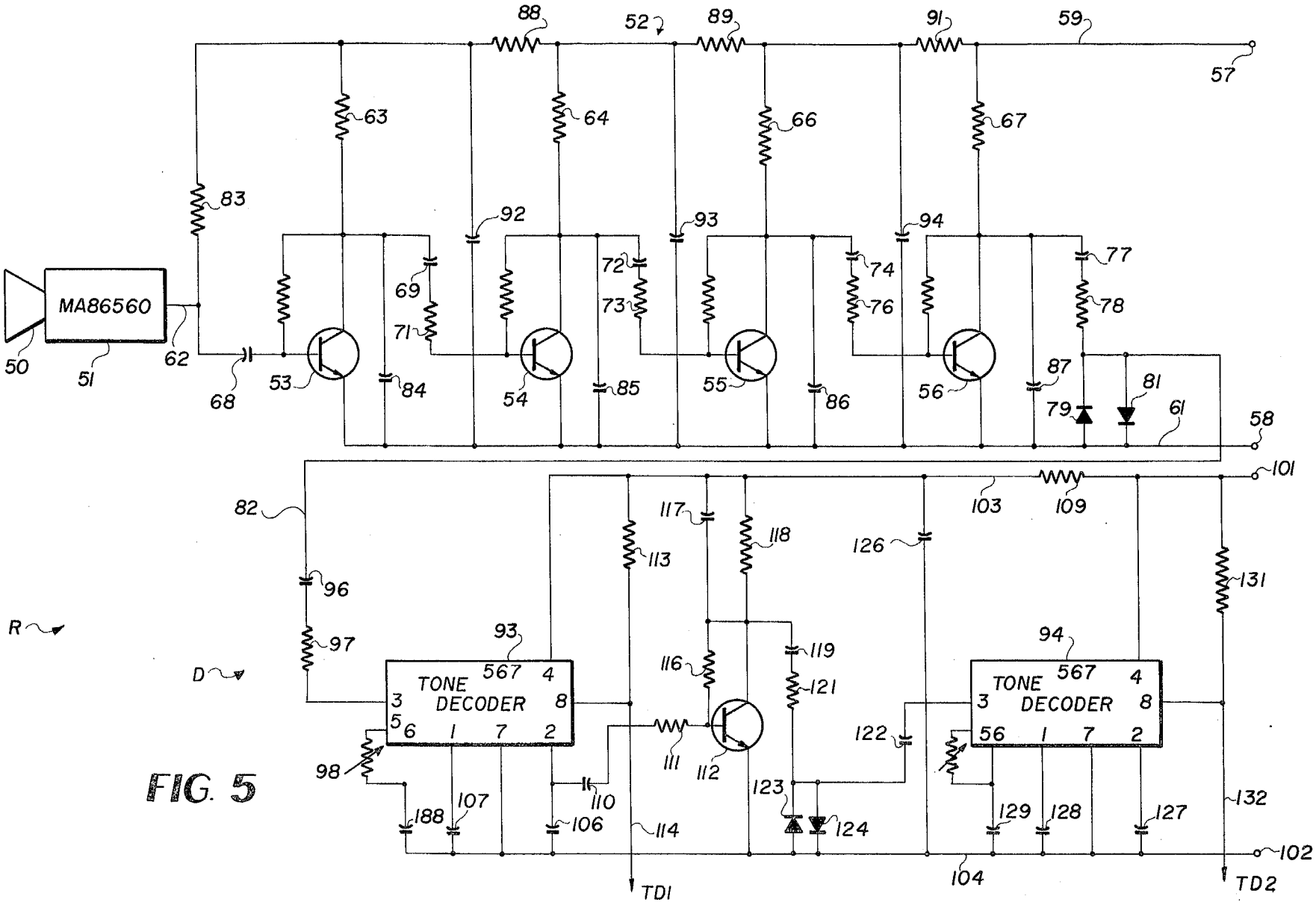
FIG. 5 is a schematic diagram of the receiver of the invention together with the detector, preamplifier and tone decoder.

Referring now to FIG. 5, there is shown the circuit for the receiver R which picks up the radiated emergency signal or transmission M from the emergency vehicle V through the receiver antenna 50 and detector 51. The detector 51 is a cavity mounted detector diode biased at approximately 20 microamperes forward current. The detected voltage is amplified by a high gain pass preamplifier 52 consisting of four stages of amplification represented by transistors 53, 54, 55, amd 56. Power is supplied to the preamplifier at terminals 57, 58, connected to conductors 59, 61 respectively with the detected voltage being fed to the preamplifier 52 from detector 51 through conductor 62. The emitters of all the transistors 53–56 are connected to conductor 61 and the collectors of the transistors through resistors 63, 64, 66 and 67 respectively to conductor 59. The detected voltage on conductor 62 is supplied through capacitor 68 to the base of transistor 53. The output voltage from the collector of transistor 53 is coupled through capacitor 69 and resistor 71 to the base of transistor 54. Similarly, the collector of transistor 54 is connected through capacitor 72 and resistor 73 to the base of transistor 55 and the collector of transistor 55 is connected through capacitor 74 and resistor 76 to the base of transistor 56. The collector of transistor 56 is connected through capacitor 77 and resistor 78 to conductor 82 and the ouput signal from transistor 56 is diode clamped by diodes 79, 81 and supplied through conductor 82 to a tone decoder designated generally by the letter D. The preamplifier 52 also includes resistor 83 connected to conductor 62 and capacitors 84, 85, 86 and 87 for connecting the collectors of transistors 53, 54, 55 and 56 respectively to the conductor 61. Resistors 88, 89, 91 are provided in conductor 59 to one side of which are connected resistors 64, 66 and 67 and which are connected at their other sides through capacitors 92, 93, 94 respectively to conductor 61.

The tone decoder D includes a type 567 phase lock loop decoder 93 and the output signal from preamplifier 52 is fed through capacitor 96 and resistor 97 to the input pin 3 of the tone decoder 93. The reference frequency of the internal VCO of tone decoder 93 is set by adjustment of the variable resistor 98, and the design bandwidth of the tone decoder 93 is set at the maximum of 14%. Since the input frequency of tone decoder 93 varies at the subtone FM modulation rate of 250 Hz, the VCO reference voltage at pin 2 also varies at that rate when the phase lock loop is locked onto and tracks the input frequency. Power to the decoder section D is supplied at terminals 101, 102 connected to conductors 103, 104 respectively. Pins 2, 1 and 6 of the tone decoder 93 are connected through capacitors 106, 107 and 108 respectively to conductor 104 and conductor 103 is connected through resistor 109 to pin 4 of tone decoder 93. Loop filter pin 2 is connected by means of capacitor 110 through resistor 111 to the base of transistor 112 and output pin 8 of tone decoder 93 is connected through resistor 113 to conductor 103 and to output line 114 which supplies one of two tones TD1, the purpose of which will be explained hereinafter. The AC component of the PLL tracking voltage is amplified by transistor 112 and supplied to a second 567 tone decoder 94 at input pin 3, Tone decoder 94 is also at 567 with the reference frequency set at the 250 Hz subtone frequency.

The base of transistor 112 is connected through resistor 116 and capacitor 117 to conductor 103 and its emitter to the conductor 104. The collector of transistor 112 is connected through resistor 118 to conductor 103 and through capacitor 119, resistor 121 and capacitor 122 to the input pin 3 of tone decoder 94. The output signal from transistor 112 is diode clamped by means of diodes 123, 124. Capacitor 126 is connected between conductors 103, 104 and pins 2, 1 and 6 of tone decoder 94 and are connected by means of capacitor 127, 128 and 129 to conductor 104. The output pin 8 of tone decoder 94 is connected through resistor 131 to conductor 103 and provides a second output tone signal TD2 on conductor 132. The two output signals TD1 and TD2 from tone decoders 93, 94 respectively are both negative output signals when the tone decoders are in lock and indicate that a valid emergency transmission has been received.

Figure 6:
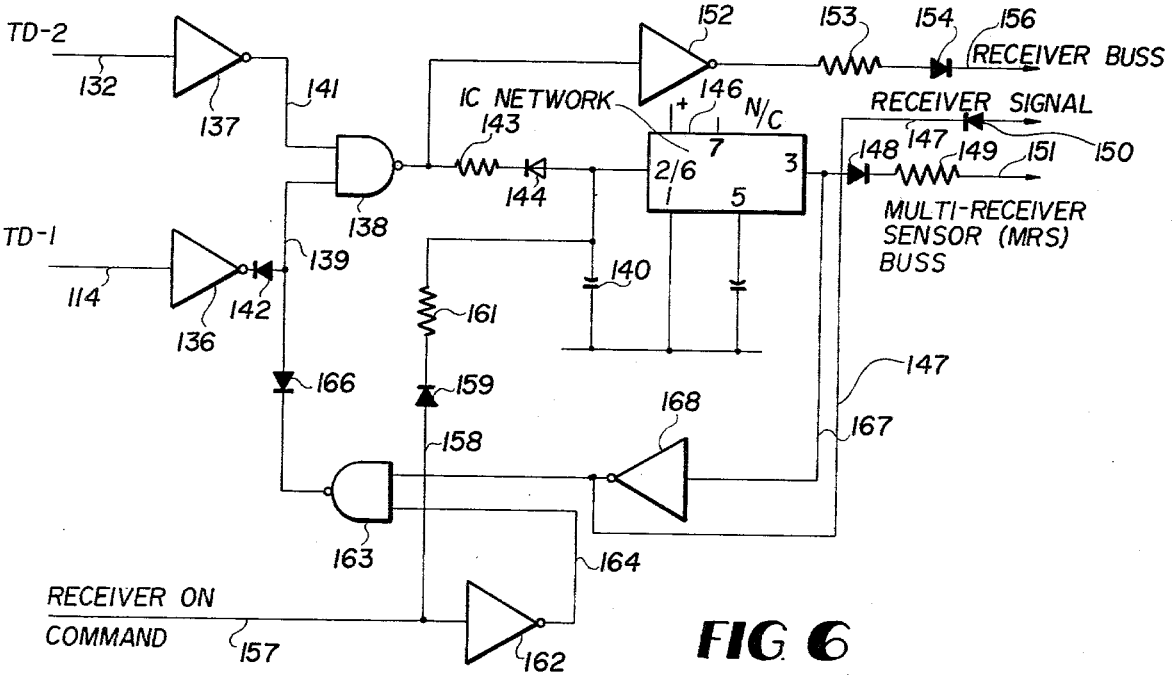
FIG. 6 is a logic diagram of a portion of the receiver circuit of the invention.

Referring now to FIG. 6 there is shown a logic diagram of the lock-inlock-out logic for each of the receivers R-R". As can be understood, the receiver which receives the transmitted beam M corresponding to the direction of movement of the emergency vehicle V functions to supply the proper signals in the system of the invention and it is necessary that the other directional receivers in the housing 11 of FIG. 3 be inhibited to prevent the processing of any additional transmissions M from another emergency vehicle V moving towards the receivers from a different direction. Thus only the receiver which first receives an emergency transmission signal M is permitted to operate and process the emergency signal as will be discussed hereinafter.

The two negative or low tone decoder output signals TD-1, TD-2 on conductors 114, 132 respectively are presented to that logic associated with the receiver first receiving the emergency signal and are fed to inverters 136, 137 respectively. Under normal operation, the outputs of inverters 136, 137 go high and are fed to the inputs of NAND gate 138 through conductors 139, 141, a diode 142 being provided between the output of inverter 136 goes low and this low signal is fed through resistor 143 and diode 144 to the input of an IC network 146 at pins 2/6 connected to negative side of the power supply through capacitor 140.

Figure 7:
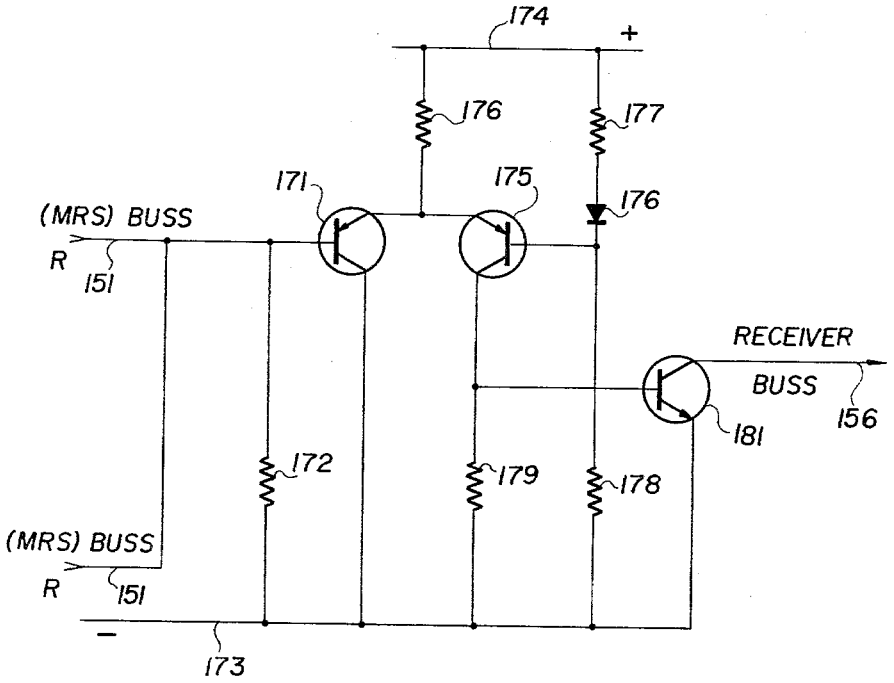
FIG. 7 is a schematic diagram of another portion of the receiver circuit of the invention.

The output of network 146 provides a output signal on conductor 167, and a multi-receiver signal which is fed to a multi-receiver sensor (MRS buss), as shown in FIG. 7, through diode 148 and resistor 149 on conductor 151. The output of network 146 is fed to the input of inverter 168 on conductor 167 and the output of inverter 168 provides a received signal on conductor 147 through a diode 150. The output of the NAND gate 138 is also conducted through inverter 152, resistor 153 and diode 154 to a receiver buss 156. The IC network 146 charges faster than the signal appearing on the receiver buss 156 so that the output signal on conductor 167 and therefore the received signal on the conductor 147 is generated prior to the generation of a "receiver on command" signal appearing on conductor 157 and generated in the circuit of FIG. 9 as will be explained hereinafter. This receiver on command signal is fed on conductor 158' through diode 159 and resistor 161 to the input of IC network at pins 2/6 thereby removing the reset bias and locking on the receiver signal appearing on conductor 147.

Figure 14:
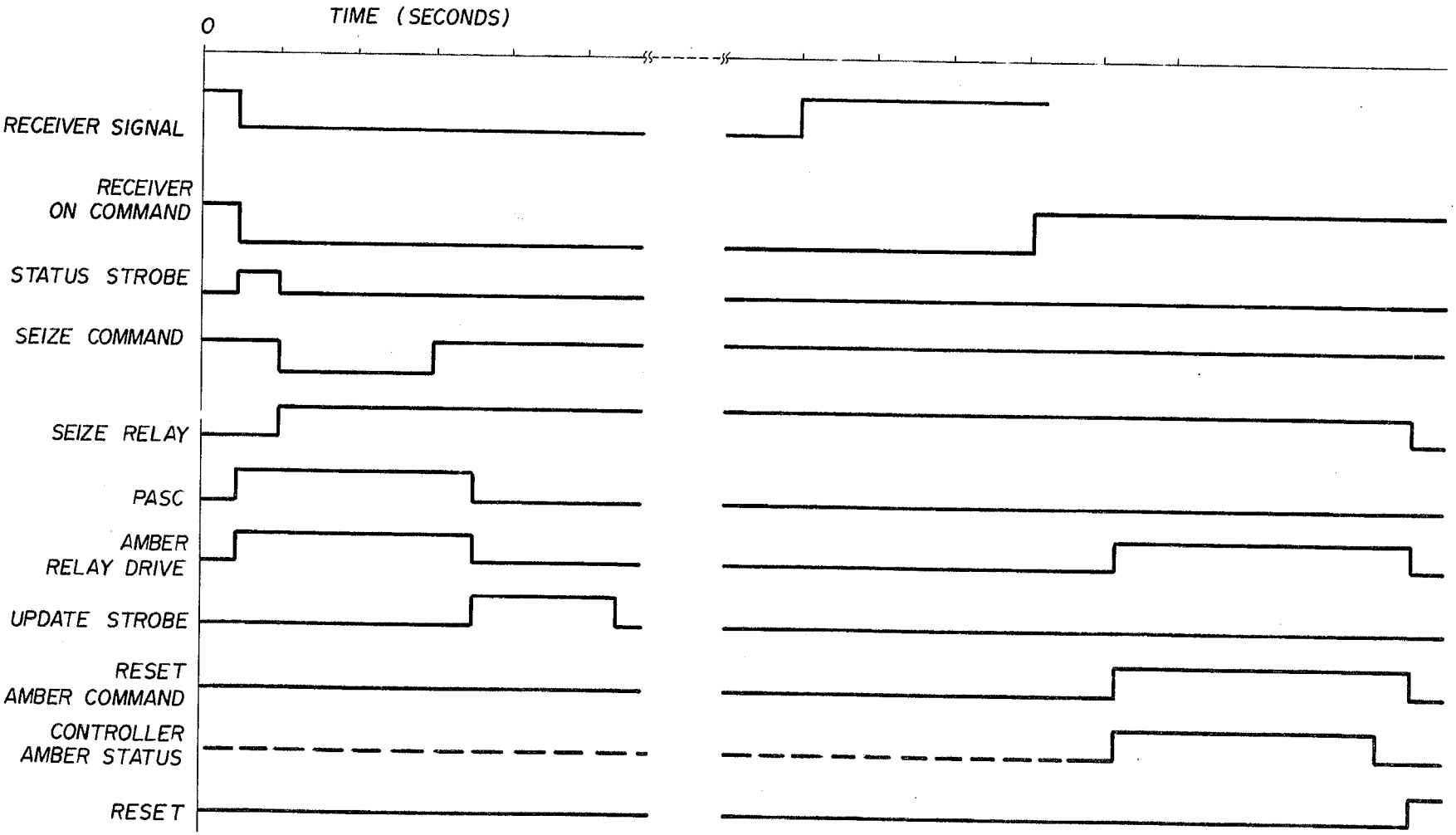
FIG. 14 is a timing diagram for the system of the invention.

As the receiver on command signal is low as shown in the timing diagram of FIG. 14, it goes high when fed to an inverter 162 the output of which is fed to NAND gate 163 through conductor 164. The output of NAND gate 163 is connected through diode 166 to the conductor 139 connected to the input of NAND gate 138. The receiver signal outputted from IC network 146 is fed on conductor 167 to the input of inverter 168, the output of which is conducted to the other input of NAND gate 163.

If IC network 146 and inverter 168 output a receiver signal represented by a high, the high input from the receiver on command signal on conductor 164 and low input to the NAND gate 163 from inverter 168 produces a high at the output of NAND gate 163 permitting the proper signal at the output of NAND gate 138 for activation of the circuit of FIG. 6 as explained above. In the event there is no receiver signal on conductor 147 indicating that the particular receiver with which the circuit of FIG. 6 is associated has not picked up an emergency transmission M, a low appears on conductor 167 so that output of NAND gate 163, when a receiver on command signal is present on conductor 157, goes low and NAND gate 138 outputs a high preventing the activation of the circuit of FIG. 6 associated with the receiver not first responding inhibiting any processing of the tone decoder output signals on conductor 114, 132. Thus, only one of the receivers R-R''' are permitted to operate after lock-in.

If two or more receivers R-R''' receiver signals at the same time indicating that multiple transmissions M are beamed from more than one emergency vehicle, the receiver signal on conductor 147 from each receiver is combined on the multi-receiver sensor (MRS) buss 151 and combined as shown in FIG. 7 so that the resulting voltage is applied to the base of transistor 171. The base of transistor 171 is connected through resistor 172 to the negative logic power conductor 173 also connected to the collector of transistor 171. The emitter of transistor 171 is connected to the emitter of transistor 175 and the emitters of both transistors are connected through resistor 176 to the positive conductor 174 of the logic power supply. The base of transistor 175 is connected through diode 176 and resistor 177 to the logic positive conductor 174 and to the logic negative conductor 173 through resistor 178. The collector of transistor 174 is connected through resistor 179 to negative conductor 173 and to the base of transistor 181, the emitter of which is connected to negative conductor 173 and the collector connected to the receiver buss 156.

With the circuit arrangement of FIG. 7, the receiver signal from each receiver R-R''' is combined at the MRS buss 151, 151', etc. and the resulting voltage on the base of transistor 171 is compared with the reference voltage at the base of transistor 175. If more than one receiver signal is present, the combined voltage will be higher than the reference voltage, causing transistor 181 to conduct thereby disabling the receiver on command signal. Therefore, when two or more receiver signals occur at the same time, further processing of the emergency transmission is prevented and the system will not function until only one receiver signal is present for at least one to two seconds. Once the receiver signal is "locked in", subsequent multiple transmissions will not inhibit further processing.

Figure 9:
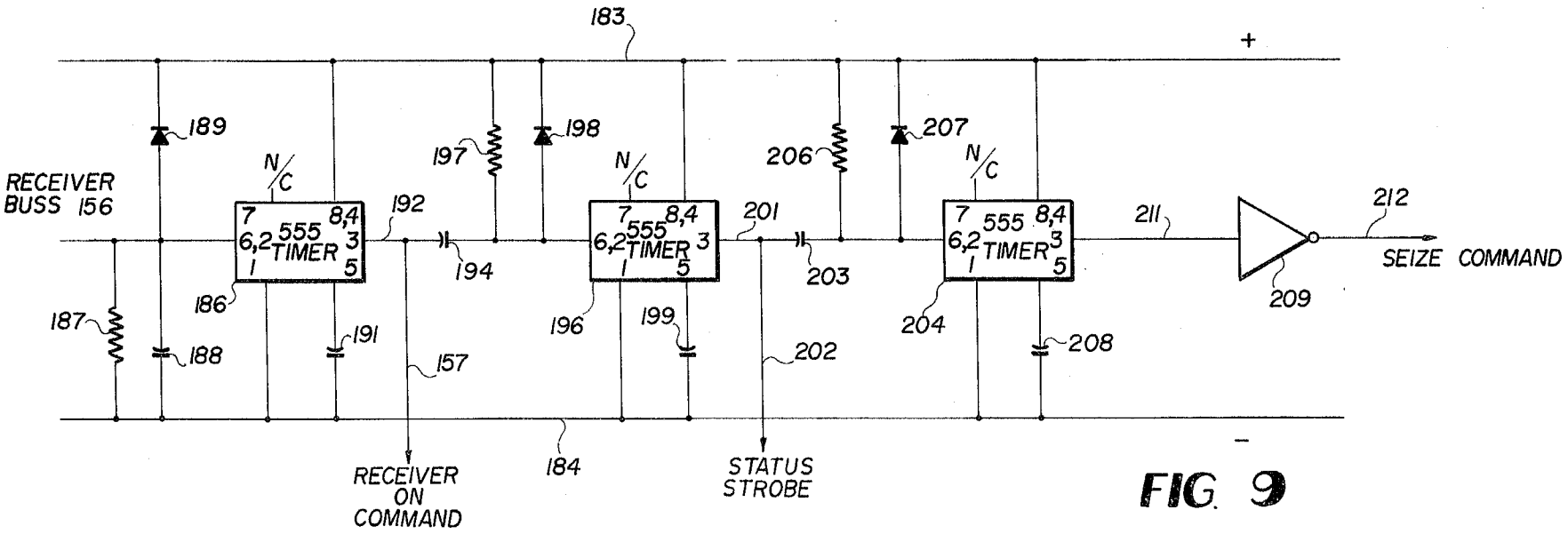
FIG. 9 is a schematic diagram of another portion of the control unit of the invention.

Referring now to FIG. 9, there is shown the circuit arrangement by means of which the control unit or preempt interrupt unit 14 of the invention is activated for switching control of the traffic signals from the main controller 16 to the preempt intercept unit. In FIG. 9, logic power is provided by positive conductor 183 and negative conductor 184 and the receiver buss signal appearing on conductor 156 in the circuit of FIG. 6 is fed to the input of a type 555 timer 186 on pins 6, 2. The receiver buss 156 is connected by means of resistor 187 to negative conductor 184 and through capacitor 188 and diode 189 to negative and positive conductors 184, 183 respectively; pin 5 on timer 186 being connected through capacitor 191 to negative conductor 184. The output of the 555 timer 186 on conductor 192 develops the receiver on command signal which is supplied via conductor 157 which, as explained above, is a low signal as shown on the timing diagram of FIG. 14. The output from timer 186 is also coupled via capacitor 194 to the input of a second type 555 timer 196 at pins 6, 2, conductor 192 being connected through resistor 197 and diode 198 to positive conductor 183. Pin 5 on timer 196 is connected through capacitor 199 to negative conductor 184.

The output of timer 196 at pin 3 appears on conductor 201 and this output signal provides on conductor 202 a signal referred to hereinafter as the status strobe signal by means of which the present status or phase of the traffic signals is sampled prior to the switching of the signals from the main controller to the control unit of the invention. The output signal from timer 196 is coupled through capacitor 203 to the input of a third type 555 timer 204 at input pins 6, 2, conductor 201 being connected through resistor 206 and diode 207 to the positive logic power conductor 183. Pin 5 on timer 204 is connected through capacitor 208 to negative conductor 184 and the output signal at pin 3 on timer 204 is fed to the input of an inverter 209 through conductor 211, the output of inverter 209 appearing on conductor 212 forming, as will be explained hereinafter, a seize command signal by means of which the switching of the traffic lights from the main controller to the control unit of the invention is accomplished. It will be noted in the timing diagram of FIG. 14, that the receiver on command and status strobe signals occur at the same time but that the seize command signal on conductor 212 does not occur until the termination of the status strobe signal. It will be noted also that the status strobe signal is high and the seize command signal is low.

Figure 10:
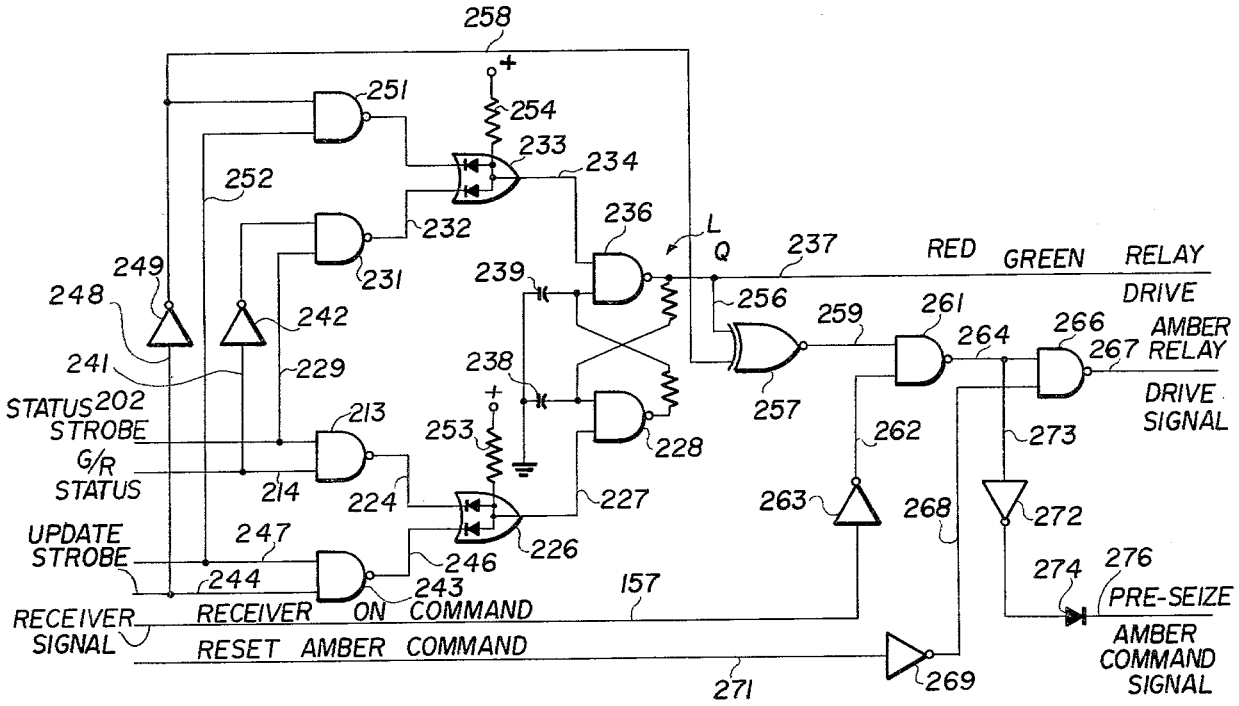
FIG. 10 is a logic diagram of the status control portion of the control unit of the invention.

Referring now to FIG. 10, there is shown a logic diagram representing the arrangement of a portion of the control unit of the invention by means of which the present condition of the traffic signals is sampled and the internal controls set so that when the traffic signals are switched from the main controller to the control unit, the traffic signals are properly set. As shown in FIG. 10, the receiver on command signal appears on conductor 157 as discussed above with reference to FIG. 9, and the status strobe signal appears on conductor 202 as also discussed with reference to FIG. 9. The status strobe signal on conductor 202 is fed to the input of a NAND gate 213, the other input of which is arranged to receive a green/red status signal representing the present status of the traffic signals on conductor 214.

Figure 12:
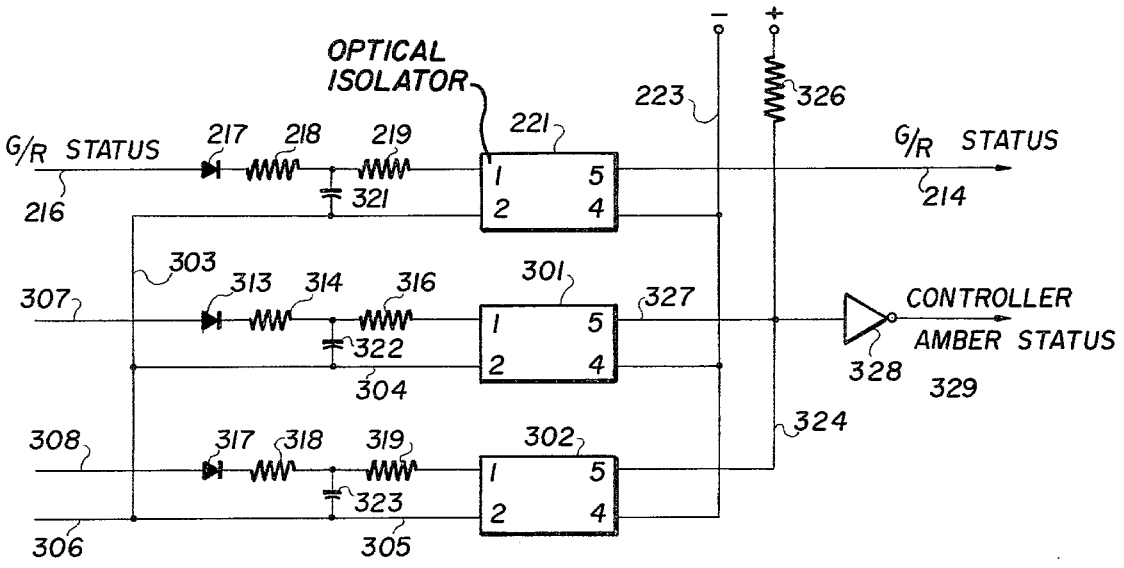
FIG. 12 is a schematic diagram of the status sensors incorporated in the control unit of the invention.

The green/red or G/R signal is obtained from conductor 216 connected to the green light of the traffic signals S and to the appropriate portion of the main controller 16 through conductor 217 as shown in FIG. 12. This G/R status signal on 214 is fed from conductor 216 through diode 217 and resistors 218, 219 to an optical isolator 221 at input pin 1 as shown in FIG. 12. The output pin 5 of optical isolator 221 is connected to the conductor 214 to provide the G/R status signal, output pin 4 being connected to the negative side of the logic power through conductor 223.

Referring now again to FIG. 10, the output of NAND gate 213 is connected by conductor 224 to one input of an OR gate 226 the output of which is connected by means of conductor 227 to one input of a NAND gate 228 forming a component of a typical latch or flip-flop designated generally by the letter L. The latch L constitutes a status latch by means of which information concerning the present status of the traffic signals is set. Status strobe conductor 202 is also connected by means of conductor 229 to one input of a NAND gate 231 the output of which is connected by means of conductor 232 to one input of an OR gate 233. The output of the OR gate 233 is connected by means of conductor 234 to one input of a NAND gate 236 forming the other gate in the status latch L.

The status latch L is connected in the conventional manner having a Q output on conductor 237 for providing a red/green relay drive signal, as will be explained hereinafter. The other inputs of the NAND gates 228 and 236 are connected to ground through capacitors 238, 239 respectively, as shown. The conductor 214 which provides the G/R status signal is connected by means of conductor 241 through inverter 242 to the other input of NAND gate 231.

The circuit of FIG. 10 also includes a NAND gate 243 to one input of which is fed an input from the associated receiver on conductor 244 which signal represents the state of the receiver with which the circuit of FIG. 10 is associated. NAND gate 243 has its output connected by means of conductor 246 to the other input of OR gate 226.

The other input of NAND gate 243 is arranged to be supplied with an update strobe signal on conductor 247, the update strobe signal being generated in the circuit of FIG. 8 as will be explained hereinafter. The receiver input signal on conductor 244 is also conducted by means of conductor 248 through an inverter 249 to one input of another NAND gate 251. Similarly, the update strobe signal is arranged to be conducted from conductor 247 through conductor 252 to the other input of NAND gate 251, the output of which is connected to the other input of OR gate 233. It will be noted that OR gates 226 and 233 are connected by means of resistors 253 and 254 respectively to the positive source of logic voltage.

The Q output conductor 237 from status latch L is connected by means of conductor 256 to one input of an exclusive NOR gate 257, the other input of which is connected to the output of inverter 249 by means of conductor 258 the input of which represents the receiver input signal from conductor 244. The output of the exclusive NOR gate 257 is connected by means of conductor 259 to the input of NAND gate 261, the other input of which is connected by means of conductor 262 to the output of inverter 263 to the input of which the receiver on command signal is fed by means of conductor 157.

The output of NAND gate 261 is connected by means of conductor 264 to one input of another NAND gate 266, the output of which provides a signal referred to hereinafter as an amber relay drive signal on conductor 267. The other input of NAND gate 266 is connected by means of conductor 268 to the output of an inverter 269 the input of which is connected to conductor 271 for supplying a signal identified as a reset amber command signal provided by the circuit of FIG. 11, as will be explained hereinafter.

Conductor 264 is also connected to the input of an inverter 272 by means of conductor 273 and the output of inverter 272 is connected through a diode 274 to conductor 276 from which is derived a signal identified as a pre-seize amber sequence command signal by means of which the update strobe signal appearing on conductor 247 is developed in the circuit of FIG. 8 as will be explained hereinafter.

Figure 8:
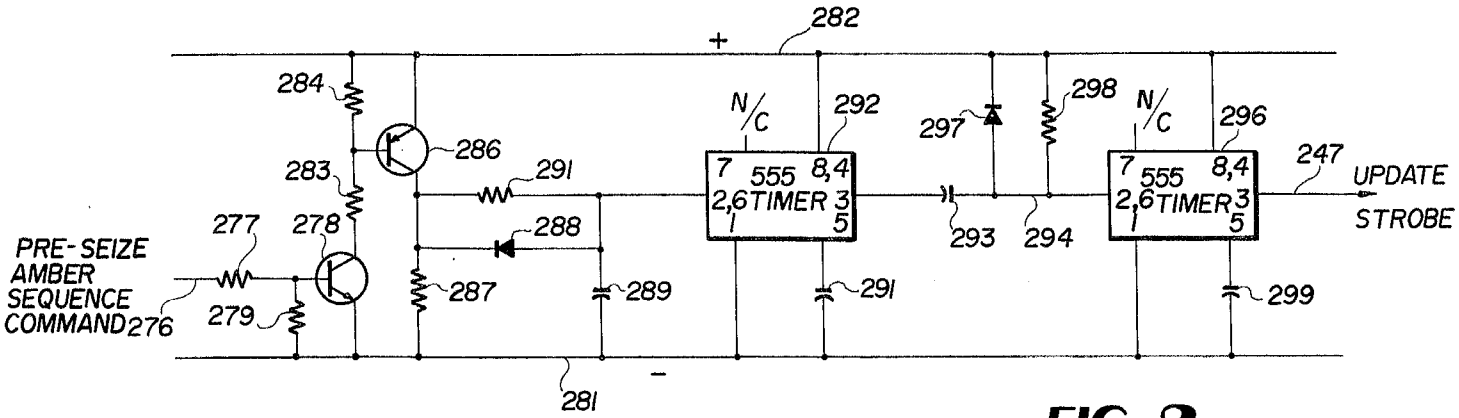
FIG. 8 is a schematic diagram of a portion of the control unit of the invention.

As shown in the circuit of FIG. 8, the pre-seize amber sequence command signal on conductor 276 is fed via resistor 277 to the base of transistor 278, conductor 276 is also being connected through resistor 279 to the negative logic voltage on conductor 281, positive logic voltage being provided on conductor 282. The emitter of transistor 278 is connected to the negative conductor 281 and the collector is connected through a voltage divider represented by resistors 283, 284 to the positive logic voltage conductor 282. The connection point of the resistors 283, 284 is connected to the base of a transistor 286 whose emitter is connected to positive logic voltage conductor 282.

The collector of transistor 286 is connected through resistor 287 to negative conductor 281, through diode 288 and capacitor 289 to the negative conductor 281 and through resistor 291 to the input of a type 555 timer 292 at pins 2, 6. Pin 5 of timer 292 is connected through capacitor 293 to negative conductor 281 and the output pin 3 of timer 292 is coupled through capacitor 293 on conductor 294 to the input pins 2, 6 of a second type 555 timer 296. Conductor 294 is also connected to positive conductor 282 through a diode 297 and a resistor 298 and timer pin 5 is connected through capacitor 299 to negative conductor 281. The output pin 3 of timer 296 therefore provides the update strobe signal on conductor 246 as previously discussed.

Referring now to FIG. 12, the status sensors incorporated in the control unit of the invention also include optical isolators 301, 302, pin 2 of which, together with pin 2 of optical isolator 221, are connected together by means of conductor 303 and conductors 304, 305, all of the pins 2 being connected by means of conductor 306 to the common conductor or negative side of a source of power, preferably 110 volts, by means of which power is supplied to the traffic signals of the invention in the conventional manner.

Figure 13:
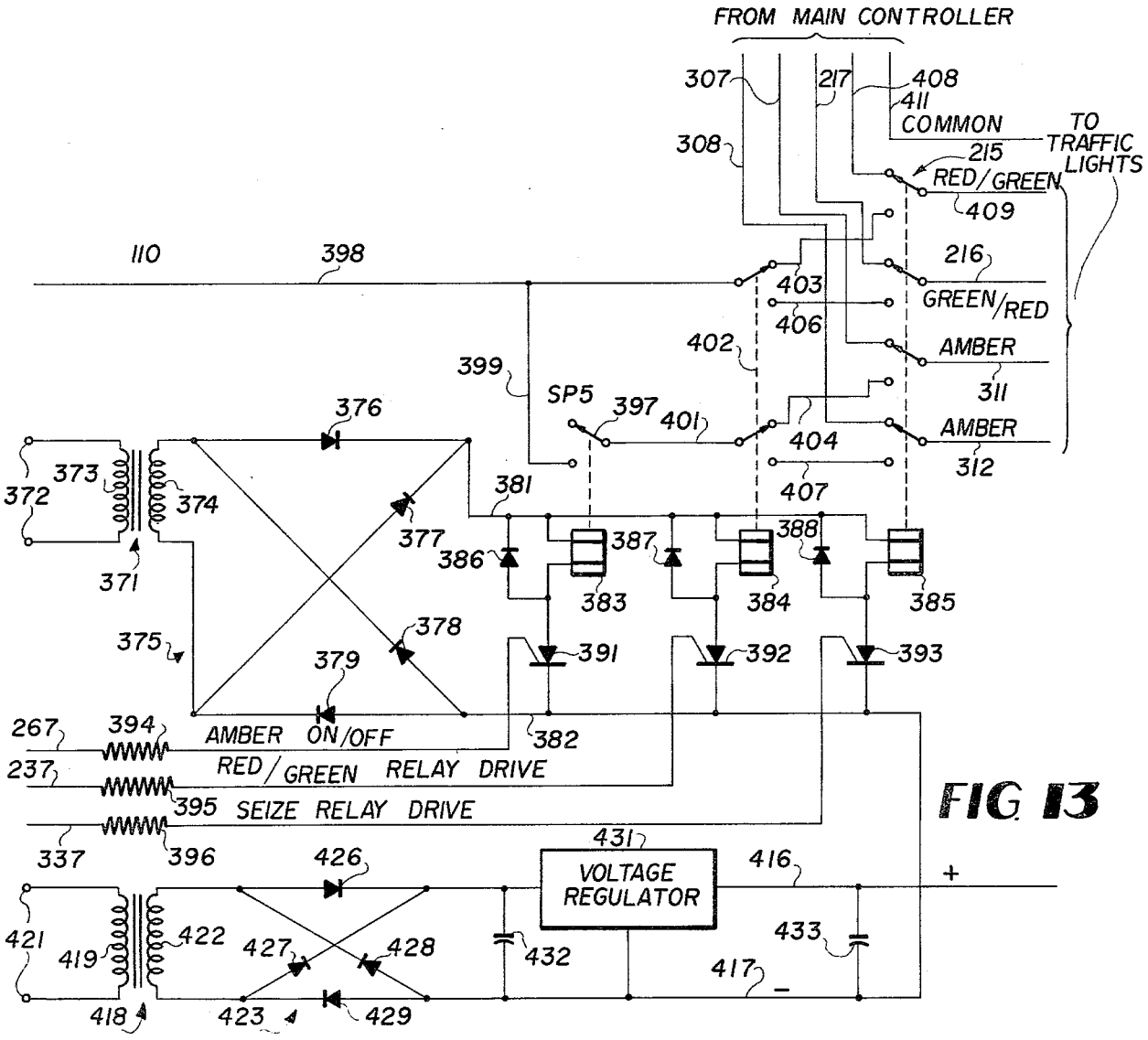
FIG. 13 is a schematic diagram of the power supply systems and relay switches incorporated in the control unit of the invention.

Isolators 301, 302 are connected to the two control conductors 307, 308 respectively by means of which power is supplied from the main controller 16 to the amber of the traffic light signals 5 through conductors 311, 312 respectively and through relay switch 215 as shown in FIG. 13.

Accordingly, conductor 307 connected to the main controller 16 is connected through diode 313 and resistor 314, 316 to pin 1 of isolater 301. Similarly, conductor 308 from the main controller 16 is connected through diode 317 and resistors 318, 319 to pin 1 of isolator 302 as shown in FIG. 12. The circuit of FIG. 12 also includes capacitors 321, 322 and 323 connected between conductors 303, 304, 305 and conductors 216, 207 and 308 respectively. Output pin 5 on optical isolator 302 is connected by means of conductor 324 through resistor 326 to the positive side of the logic power supply and to pin 5 of optical isolator 301 by conductor 327. Pins 4 on optical isolator 301, 302 are connected to the negative side of the logic voltage as is pin 4 of isolator 221 through conductor 223.

The output pins 5 on isolators 301, 302 which are connected to the two amber light conductors 307, 308 respectively from the main controller 16 are both connected through conductor 327 to inverter 328 the output of which provides a signal referred to hereinafter as the controller amber status signal, which signal reflects the status of the amber control setting of the traffic lights as established by the main controller 16.

Figure 11:
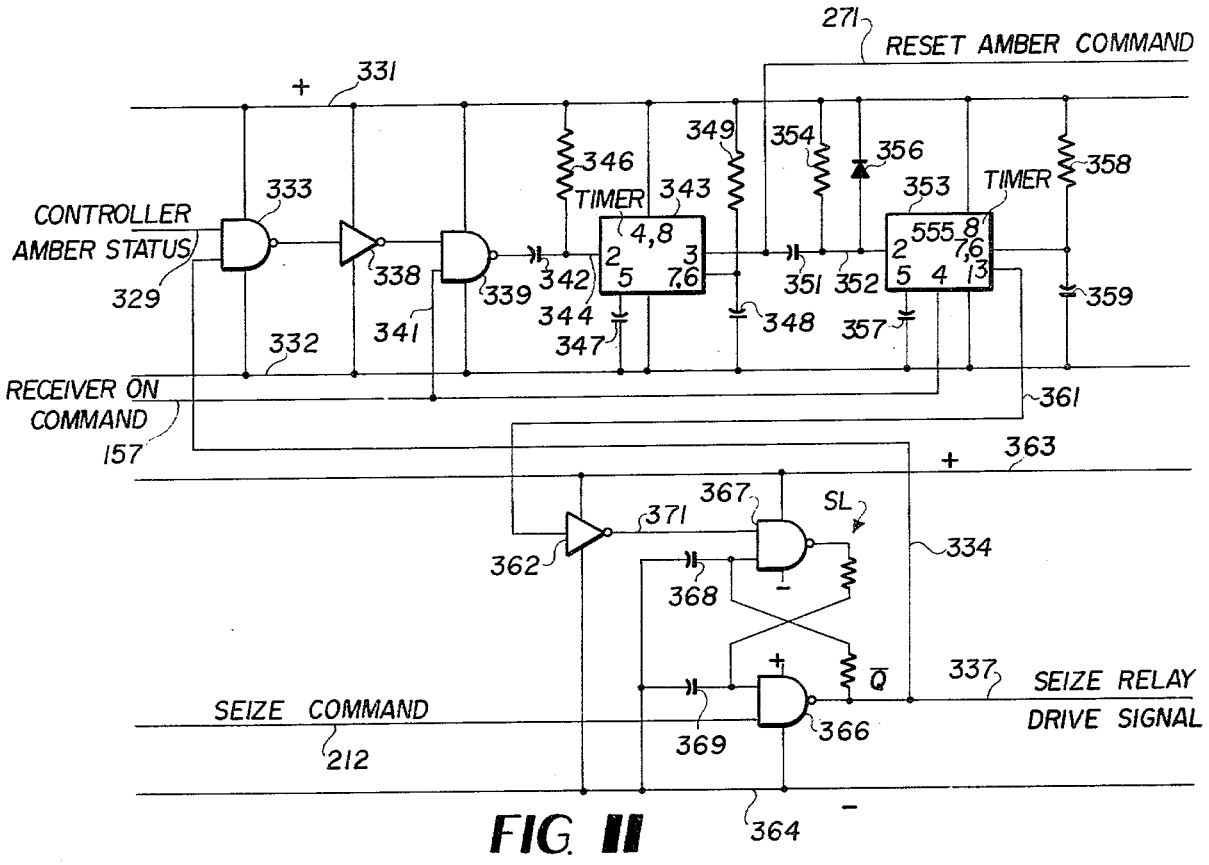
FIG. 11 is a logic diagram of the seize and reset control portion of the control unit of the invention.

Referring now to FIG. 11, there is shown the seize and reset control circuit for the control unit to which logic power is supplied on positive conductor 331 and negative conductor 332. The controller amber status signal appearing on conductor 329 as discussed above with reference to the circuit of FIG. 12 is supplied to one input of a NAND gate 333 connected across conductors 331, 332, the other input to the NAND gate 333 being connected by conductor 334 to the output of a flip-flop or "seize latch" designated generally by the letters SL. The $\overline{Q}$ of the seize latch SL appears on conductor 337 and provides an output signal identified as the seize relay drive signal as will be explained hereinafter.

The output of NAND gate 333 is supplied to the input of inverter 338 connected across conductors 331, 332, the output of which is supplied to one input of another NAND gate 339 connected also across conductor 331, 332. The other input of NAND gate 339 is connected by means of conductor 341 to conductor 157 for supplying the receiver on command signal as discussed with reference to the circuit of FIG. 9. The output of NAND gate 339 is coupled through capacitor 342 to the input of a type 555 timer 343 by means of conductor 344 connected through resistor 346 to the positive logic conductor 331, pins 4, 8 of timer 343 being connected to conductor 331. Pin 5 of timer 343 is connected through capacitor 347 to the negative logic voltage conductor 332, pins 7, 6 of the timer 343 being connected through capacitor 348 and resistor 349 to conductor 332 and 331 respectively.

The output of timer 343 appearing on pin 3 is connected by means of coupling capacitor 351 in conductor 352 to the input pin 2 of another type 555 timer 353, conductor 352 being connected through resistor 354 and diode 356 to conductor 331 as shown. The output pin 3 of timer 343 is also connected to conductor 271 to provide the reset amber command as discussed above with reference to the circuit of FIG. 10.

Pins 1, 8 of timer 353 are connected to conductor 332, 331 respectively, pin 5 is connected through capacitor 357 to conductor 332 with pins 7, 6 connected to conductors 331, 332 through resistor 358 and capacitor 379 respectively. Output pin 3 of timer 353 is connected by means of conductor 361 to the input of an inverter 362, the output of which is supplied to the seize latch SL. Pin 4 on timer 353 is connected to conductor 157.

Logic power is supplied to the seize latch SL on positive conductor 363 and negative conductor 364. The seize latch SL is a conventional flip-flop comprising NAND gates 366, 367 having a conventional configuration, one input of each of the NAND gates 366, 367 being connected by means of capacitors 368, 369 to the negative logic voltage conductor 364. The other input of NAND gate 367 is connected to the output of the inverter 362 by means of conductor 371 and the other input of NAND gate 366 is connected to the conductor 212 on which the seize command signal appears as discussed with reference to the circuit of FIG. 9.

Referring now to FIG. 13, there is shown the power supply circuitry for the invention. The arrangement of FIG. 13 includes a power transformer 371, the primary coil of which is supplied with a conventional source of electrical power, preferably 110 volts, at terminals 372. The secondary coil of step-down transformer 371 supplies a secondary voltage of approximately 12 volts to a full wave rectifier including diodes 376–379, the rectified voltage of which appears on conductors 381, 382. Conductor 381 is connected to one side of three relay coils 383, 384, 385 having associated therewith damping diodes 386, 387, 388 respectively, the relay coils forming a part of what are referred to hereinafter as the amber on/off relay, the red/green relay and the seize relay respectively.

The other side of relay coils 383, 384, 385 are connected through SCRs 391, 392, 393 respectively, the other sides of which are connected to the conductor 382. The gates of the SCRs 391, 392, 393 are connected to conductors 267, 237 and 337 through resistors 394, 395 and 396 by means of which the amber on/off, the red/green relay drive and seize relay drive signals respectively are supplied to the SCRs.

The amber on/off relay coil 383 is arranged to actuate a SPST switch 397 movable between the solid line and the dotted line positions of FIG. 13 which in the dotted line position is arranged to bridge terminals to connect conductor 399 to conductor 401. Conductors 398 and conductor 401 are connected to a DPDT switch 402 associated with the red/green relay coil 384 and movable between the solid line and the dotted line positions of FIG. 13. In the solid line position, switch 402 is arranged to connect conductors 398, 401 to conductors 403, 404 and in the dotted line position to conductors 406, 407.

Switch 215 associated with the seize relay coil 385 is also movable between the solid line and the dotted line positions of FIG. 13 and starting from the top and proceeding downward, the first contactor in the solid line position connects conductor 408 from the main controller to conductor 409 connected to the red/green light in the set of traffic signals associated with the main controller 16. As is conventional, common line 411 is associated with the main controller 16 and the traffic signals S. The second contactor in the solid line position of FIG. 13 connects conductor 217 with conductor 216, the third contactor connects conductor 307 with amber light conductor 311 and the fourth contactor connects conductor 308 with amber light conductor 312.

In the dotted line position, the first contactor connects conductor 403 with conductor 409 for the red/green light, the second contactor connects conductor 406 with conductor 216 for the green/red light, the third contactor connects conductor 404 with conductor 311 for the amber light, and the fourth contactor connects conductor 407 with the amber light through conductor 312.

The logic power supply, preferably 5 volts, appears across positive conductor 416 and negative conductor 417, negative conductor 417 being connected to the negative side of the full wave bridge rectifier 423. The logic power supply is developed through a power transformer 418, the primary winding 419 of which is supplied with the 110 volts source of power at terminals 421. The secondary winding 422 of power transformer 418 supplies 12 volts to the full wave bridge rectifier 423 comprising diodes 426–429, the output of which is supplied to a voltage regulator 431 which maintains the logic power supply at 5 volts. A separate transformer 371 is used to power the relay coils 383–385 because of the high current and current surge requirements of the relay coils. Capacitor 432, 433 are connected across the logic power conductors 416, 417 on opposite sides of the voltage regulator 431, the voltage regulator 431 being connected to conductor 416 and to conductor 417 as shown.

In the operation of the invention, an emergency vehicle V approaching the intersection I as shown in FIG. 1 transmits a beam M in the direction shown from the transmitter T by closure of the switch 19 by the operator as shown in FIG. 4. As shown in FIG. 4, the encoder 12 including the timers 30, 25, generates a special AM/FM tone code which modulate the microwave oscillator 21 so that a microwave beam M is transmitted in the direction shown in FIG. 1 by the directional horn antenna 20 to the intersection I ahead of the vehicle V. As each receiver R-R''' in the housing 11 associated with the traffic signals S are oriented to the four different directions of approach of the emergency vehicle V, receiver R, for instance, whose directional horn antenna receives the transmitted beam M as shown in FIG. 3.

The transmitted emergency signal or tone code received by the horn antenna 50 of the receiver R as shown in FIG. 5 is then amplified in the four stage pre-amplifier 52 and the amplified signal fed on conductor 82 to the input of the decoder D. The code decoder D is activated only by the specific tone code of the transmission M thereby preventing activation of the control system by noise of unwanted signals. The code decoder D then develops two signals on conductors 114, 132 identified as TD1 and TD2 in FIG. 5, if the correct tone is present in the transmission M.

When the correct tone code is received by receiver R and the signals TD1, TD2 developed, these signals are fed to a control unit or pre-empt intercept unit which is the portion of the traffic control system of the invention which actually controls the traffic signals S. More specifically, and referring now to FIG. 6, the receipt of an emergency signal by one of the receivers R-R''' requires that the other receivers be inhibited to prevent any emergency commands from two different directions being presented to the pre-empt intercept unit at the same time. This function is performed by the receiver lock-in-lock-out logic as shown in the logic diagram of FIG. 6. In the logic circuit of FIG. 6, the tone signals TD1, TD2 are fed through inverters 136, 137 to the NAND gate 138 for activating the IC network 146 so that the output of inverter 168 provides the receiver signal on line 147 which is also fed on conductor 152 to the multi-receiver (MRS) buss. The output of the NAND gate 138 is also inverted in inverter 152 and appears on the receiver buss conductor 156.

As shown in FIG. 9, the signal on receiver buss 156 is fed to timer 186 the output of which produces the receiver on command signal on conductor 157. The development of the receiver on command signal indicates the activation of the particular receiver which first receives the transmission M.

When an emergency signal has been received by one of the receivers R-R''', it is necessary that all of the other receivers except the one receiving the emergency signal be inhibited to prevent the processing of any emergency signals from another direction at the same time. This is accomplished in the circuits of FIGS. 6, 7 wherein the tone code signals TD1, TD2 are fed to inverter 136, 137 on conductors 114, 132 respectively. The outputs of the inverters 136, 137 are fed to the input of NAND gate 138, the output of which is fed through resistor 143 and diode 144 to the input of the IC network 146. The NAND output signal is also fed to the input of inverter 152 the output of which appears on the receiver buss 156. The output of network 146 provides a receiver signal on conductor 147 and this network output is also fed to the multi-receiver sensor buss 151 connected to the circuit of FIG. 7 to which the other receivers are also connected.

The IC network 146 charges faster than the signal is produced on the receiver buss so that the receiver signal on conductor 146 at the output of network 146 is generated prior to the receiver on command signal at the output of timer 186 activated by the receiver buss signal on conductor 156 as shown in FIG. 9. Thus, when the receiver on command signal is generated, it is conducted to the input of IC network 146 on conductor 158 so as to remove the reset bias from the network and the receiver signal is locked on. At the same time, the receiver on command signal on conductor 157 is fed through inverter 162 on conductor 164 to one input of NAND gate 163. The receiver signal is fed on conductor 167 through inverter 168 to the other input of NAND gate 163, the output of which is fed on conductor 139 to the input of NAND gate 138 to which the tone signal TD1 is applied. If no receiver signal is present on conductor 167 both inputs to NAND gate 163 are high so that the output of NAND gate 163 goes low inhibiting the reception of the tone signals TD1, TD2. If a receiver signal is present on conductor 167 indicating that the associated receiver has been activated, the input to NAND gate 163 from inverter 168 is low so that the tone signals TD1, TD2 applied to the inputs of NAND gate 138 are not inhibited in producing the receiver signal at the output of IC network 146. Thus, only that receiver first receiving the emergency signal is permitted to operate after lock-in.

During the first few seconds of operation, when the circuitry determines which receiver is to control the system, the receipt of emergency signals by two or more receivers at the same time indicating the presence of more than one emergency vehicle, the circuit of FIG. 6 disables the receiver on command signal until only one receiver signal is present. More specifically, the receiver signals from each receiver under such conditions is combined on the MRS buss through diode 148 and resistor 149 of each receiver and this resulting voltage is applied to the base of transistor 171 in the circuit of FIG. 7 as explained above. The resulting voltage on the base of transistor 171 is compared with the reference voltage on the base of transistor 175. In the presence of more than one receiver signal resulting in a higher voltage than the reference voltage, transistor 181 will conduct and the resulting output on receiver buss 156 will disable the receiver on commond signal. Accordingly, when two receiver signals occur at the same time, the control unit will not function until only one receiver signal is present for at least one or two seconds. Once the receiver signal has locked in, subsequent multiple transmissions will not inhibit operation and the control system of the invention will operate with one activated receiver until the emergency signal pertaining to that receiver is discontinued.

Referring now to FIG. 9, when the receiver on command signal has been generated on conductor 157 from the output of time 186, timer 196 simultaneously generates a status strobe signal on conductor 202 as shown in the timing diagram of FIG. 14. The status strobe signal on conductor 202 together with the G/R status signal on conductor 214 in FIG. 10 are applied to the inputs of NAND gate 213 and NAND gate 231 to set the status latch L according to the present status of the traffic signals S which, at this time, are under the control of the main controller 16. The output of the status latch L on conductor 237 therefore determines the actuation of relay coil 384 by the red/green relay drive signal gated to SCR 392 so that the switch 402 either remains in the solid line position of FIG. 13 or is moved to the dotted line position upon actuation of the relay coil 384. As explained above, the G/R status signal on conductor 213 is derived from the output pin 5 of optical isolator 221 the input of which is connected through conductor 214 to the conductor 216 of the traffic light.

As will be explained hereinafter, the output of status latch L is also fed to one input of the exclusive NOR gate 257. The receiver input signal on conductor 258 is applied to the other input of the exclusive NOR gate 257 and if the output of the status latch L on conductor 237 as applied to one input of the exclusive NOR gate 257 is different from the receiver input signal applied to the other exclusive NOR gate input, the exclusive NOR gate 257 goes high. This high fed to the input of NAND gate 261 together with the high output of inverter 263 from the receiver on command signal on conductor 157 will generate an amber relay drive signal on conductor 266 at the high output of NAND gate 266 resulting from a low input to gate 266 on conductor 264 and a pre-seize amber command signal on conductor 276 from the high output of inverter 272 as shown in FIG. 10.

The pre-size amber sequence command signal on conductor 276 produces an update srobe signal on conductor 247 as shown in FIG. 8. The amber relay drive signal on conductor 267 applied as a gating signal to SCR 391 energizes the amber on/off relay coil 393 to move the switch 397 from the solid line to the dotted line position of FIG. 13 thereby activating the appropriate amber light at the time control of the traffic signals are assumed by the control unit of the invention.

As indicated in the timing diagram of FIG. 14 and in the circuit of FIG. 9, timer 204 generates a seize command signal on conductor 212 at the output of inverter 209 at the end of the status strobe signal on conductor 202 and this seize command sets the seize latch SL shown in FIG. 11. The setting of the seize latch SL outputs the seize relay drive signal on conductor 337 which is applied to the gate of SCR 393 to energize the seize relay coil 385 and moves the seize relay switch 215 from the solid line position to the dotted line position of FIG. 13 thereby transferring control of the traffic lights from the main controller 16 to the control unit of the invention. If the amber relay drive signal on conductor 267 and the pre-seize amber command signal on conductor 276 are present so that switch 397 has been moved into the dotted line position of FIG. 13, the appropriate amber light connected to conductors 311 and 312 is activated at the time relay coil 385 is energized.

The pre-seize amber command signal which has been generated on conductor 276 starts the timing sequence on timers 292 and 296 of FIG. 8 to produce at the output of timer 296 the update strobe signal on conductor 247 which is applied together with the receiver input signal to the inputs of NAND gate 243 as shown in FIG. 10. The status latch L is then set by the outputs of OR gates 226, 233 to match the receiver input signal on conductor 244. If the status latch L at the time of the status strobe is in the same state as that required by the receiver input, the output of the exclusive NOR gate 257 remains low so that the amber relay drive signal and pre-seize amber command signals are not produced and the amber sequence and update strobe do not occur.

Referring now to FIG. 11, when the emergency transmission has been terminated and the receiver signal is absent for at least three seconds indicating that the emergency has passed, the first amber sequence from the main controller on conductor 207 of FIG. 12 produces, at the output of inverter 328 from output pin 5 of optical isolator 301 on conductor 329, a controller amber status signal. This controller amber status signal is applied to one input of NAND gate 333 and in the absence of the receiver on command signal on conductor 157 produces a reset amber command signal on conductor 271 at the output of timer 343. The reset amber command on conductor 271 is applied to the input of inverter 269 as shown in FIG. 10 to produce at the output of NAND gate 266 the amber relay drive signal on conductor 267 again activating the relay coil 383 to move switch 397 to the dotted line position to connect the amber light to the power source. At the end of a short period of time as determined by timer 353, the output of timer 353 is applied to the seize latch SL through inverter 362 to reset the latch and de-energize the relay coil 385 of the seize relay 215 permitting the switch 215 to return to the solid line position of FIG. 13 thereby returning the traffic signals S back to the main controller 16.

An outstanding feature of this invention is that it can be easily installed in association with a conventional system of traffic signals having a main controller which continues to function in a normal manner even though the signals are preempted by the control unit of the invention under emergency conditions. Thus, there is no interference with the main controller before, during of after the operation of the invention and the established control sequence which operates the traffic signals under normal conditions is continuously maintained at all times. In addition, the invention may be installed without any modifications to the main controller of the existing system and may be used in association with any type of main controller incorporated in a traffic signal control system.

What is claimed is:

1. An emergency control system for traffic signals including red, green and amber lights and a main controller connected to said lights comprising, in combination, means on an emergency vehicle for generating and transmitting a microwave beam in the direction of travel of the vehicle, receiver means operatively associated with the traffic signals for receiving said transmitted beam, means connected to said receiver means for generating a command signal indicative of an emergency condition, a control unit including control means responsive to said command signal for sampling and storing the existing status of said traffic lights, said control means including means for incorporating an amber signal when the sampled signals are different from the desired emergency signals, seizing switch means movable between a first position for connecting said traffic lights to said main controller and a second position for connecting said traffic lights to said control means, said seizing switch means being normally positioned in said first position, means conditioned by said command signal for moving said seizing switch means subsequent to the storage of the existing status of said traffic lights by said control means into said second position for connecting said traffic lights to said control means and means for resetting said seizing switch means including means for initiating an amber signal by said main controller in the direction of travel of said emergency vehicle when said command signal is terminated to permit said seizing switch means to move into said first position for operation of said traffic lights by said main controller.

2. An emergency control system in accordance with claim 1 wherein said control means for sampling and storing the existing status of said traffic lights include status switch means movable into a position corresponding to a selected status of said traffic lights and means for positioning said status switch means into a position corresponding to a selected status of said traffic lights.

3. An emergency control system in accordance with claim 1 wherein said means for generating and transmitting a microwave beam includes an encoder for tone coding said microwave beam and wherein said receiver means includes a decoder for decoding said tone coded beam to produce an output signal.

4. An emergency control system in accordance with claim 3 wherein said means for generating and transmitting a microwave beam includes a microwave oscillator.

5. An emergency control system in accordance with claim 1 including a plurality of said receiver means operatively associated with said traffic signals, each of said receiver means being directionally oriented so as to receive a microwave beam transmitted in the direction to which said receiver means is oriented.

6. An emergency control system in accordance with claim 5 wherein said control unit includes means for inhibiting the operation of the other of said receiver means when said command signal is generated by said generating means connected to the one receiver means receiving said microwave beam.

7. An emergency control system in accordance with claim 5 wherein said control unit includes means for disabling said command signal generating means when microwave beams from a plurality of directions are received substantially simultaneously by a plurality of receiver means.

8. An emergency control system in accordance with claim 1 wherein said means for initiating said amber signal include means connected to said main controller for sensing the amber light control status of said main controller and means for activating said resetting means after termination of said command signal when said amber light control status is sensed by said sensing means.

9. An emergency control system in accordance with claim 1 including means for comparing the existing status of said traffic lights stored by said control means with the output from the command signal generating means connected to the receiver means receiving said microwave beam and means for modifying the stored status of said traffic lights in said control means when said comparing means indicates a difference between said stored status and said command signal generating means output.

10. An emergency control system in accordance with claim 9 wherein said comparing means includes an exclusive NOR gate.

11. An emergency control system in accordance with claim 9 wherein said control unit includes a normally open relay switch for connecting said amber light to an associated source of power and means connected to said comparing means for closing said relay switch to connect said amber light to said source of power when said comparing means indicates a difference between said stored status and said command signal generating means output.

12. An emergency control system in accordance with claim 11 wherein said modifying means includes means for generating an update strobe signal when said comparing means indicates a difference between said stored status and said command signal generating means output and gating means for receiving said update strobe signal and said command signal generating means output to produce an output signal and means responsive to said output signal for changing the stored status of said traffic light.

13. An emergency control system in accordance with claim 2 wherein said means for generating said command signal include means for generating a status strobe signal, and including means for sensing the green/red status of said traffic light and wherein said control means includes gating means connected to said status strobe signal generating means and said green/red status sensing means to produce an output signal indicative of the existing status of said traffic lights and storage means conditioned by said output signal for said gating means for storing the existing status of said traffic lights.

14. An emergency control system in accordance with claim 13 wherein said storage means comprises a flip-flop.

15. An emergency control system in accordance with claim 13 wherein said means for generating said command signal include means for generating a seize command signal and including circuit means for connecting said seize command signal generating means to said seizing switch means for moving said seizing switch means to said second position.

16. An emergency control system in accordance with claim 15 wherein said circuit means includes a flip-flop.

* * * * *